US011528974B1

(12) United States Patent
Myers et al.

(10) Patent No.: US 11,528,974 B1
(45) Date of Patent: Dec. 20, 2022

(54) COLLECTIBLE CARD PACKAGE CASE

(71) Applicant: B1Q Studios LLC

(72) Inventors: Christopher Ryan Myers, York, PA (US); Steven Michael Myers, York Haven, PA (US)

( * ) Notice: Subject to any disclaimer, the term of this patent is extended or adjusted under 35 U.S.C. 154(b) by 0 days.

(21) Appl. No.: 17/455,153

(22) Filed: Nov. 16, 2021

(51) Int. Cl.
*A45C 11/18* (2006.01)
*B42F 7/14* (2006.01)
*B42F 7/04* (2006.01)

(52) U.S. Cl.
CPC ..... *A45C 11/18* (2013.01); *B42F 7/04* (2013.01); *B42F 7/14* (2013.01)

(58) Field of Classification Search
CPC ..... A45C 11/18; B42F 7/04; B42F 7/14
USPC ..... 206/449, 455, 456, 470, 232, 8, 387.13, 206/308.3; 220/4.27
See application file for complete search history.

(56) References Cited

U.S. PATENT DOCUMENTS 4,671,408 A * 6/1987 Raines ..... A61M 5/002 206/45.23
4,979,619 A * 12/1990 Hager ..... B42F 7/00 150/147
5,040,671 A * 8/1991 Hager ..... A45C 11/18 206/39
5,042,650 A * 8/1991 Mayer ..... G09F 3/20 206/0.8
5,485,919 A * 1/1996 Samberg ..... B65D 75/24 206/278
D420,584 S * 2/2000 Hopkins ..... D9/423
7,306,159 B1 * 12/2007 Rochelo ..... A45C 11/18 206/483
7,556,152 B2 * 7/2009 Lechelle ..... B65D 75/24 206/509
10,166,074 B2 * 1/2019 Jatana ..... A61B 50/30
2008/0067101 A1 * 3/2008 Dewa ..... A63F 1/06 206/579
2010/0320100 A1 * 12/2010 Holden ..... A45F 3/14 206/232
2021/0022467 A1 * 1/2021 Cox ..... A45C 13/1069

* cited by examiner

*Primary Examiner* — Jacob K Ackun
(74) *Attorney, Agent, or Firm* — Steve O'Donnell

(57) ABSTRACT

An apparatus for storing collectibles is disclosed. The apparatus is particularly useful for storing collectible packs of cards that are commonly sold as "booster packs" for larger decks. The apparatus has multiple rails which support the booster pack without crimping or damaging the flaps at the top and bottom of the pack. As the pack is supported by the flaps and not by friction of the body of the pack itself, the apparatus can have a larger internal space to accommodate a variety of sizes of packs having similar flaps.

4 Claims, 7 Drawing Sheets

COLLECTIBLE CARD PACKAGE CASE

FIELD OF THE INVENTION

The subject matter of this application pertains to methods and devices for protecting collectible items. More particularly, the subject matter of this application pertains to methods and devices for protecting collectible packs of cards. Even more particularly, the subject matter of this application pertains to methods and devices to protect and display collectible packs of cards. Even more particularly, the subject matter of this application pertains to methods and devices for protecting packs of collectible card game cards which have sealed flaps.

BACKGROUND OF THE INVENTION

People have been collecting cards since their introduction in the second half of the nineteenth century. Initially, such cards typically bore pictures of sports stars. Over time, the breadth of topics printed on collectible cards grew to include non-sports entertainment cards such as movies and tv shows, comics, and pinups, among others.

In 1993, the first Magic: The Gathering cards were released, which started the collectible card game craze. Game play varies greatly between games; however, very basically, within a collectible card game, each card represents a character, force, event, or whatever else makes sense within the mechanics of the game. Players select a portion of their cards to build a deck, and then use the cards within that deck to engage in combat with the other players.

Since each card has its own strengths and weaknesses, it is in the player's interest to have a large selection of cards from which they can build several customized, strong decks. This keeps the players engaged and encourages purchasing additional packs of cards.

Not all cards are evenly distributed as one might expect in a set of baseball or football cards though, and the scarcity of certain cards is what really drives the collectible nature of these cards.

Each game or set of cards can have its own scarcity tiers, with rarer cards being the most sought after either for their strength in the game itself or their value, particularly on the secondary market. The most sought-after and rarest collectible cards can easily fetch tens of thousands of dollars at auction.

Retail sets of cards for such a collectible card game may be sold as a complete deck which allows a purchaser to begin playing the game or as booster packs. Booster packs can augment a starter pack by adding new and interesting cards. A booster pack of cards usually has between 10 and 15 cards. The packs are usually made of a cellophane or similar material sleeve surrounding the cards. The sleeve's openings are sealed at the top and bottom of the pack resulting in a top and bottom flap. With each pack is a chance of finding a scarce and valuable card, but a better chance of finding cards of somewhat less monetary value. In other words, the act of buying a pack of cards is itself a form of gambling.

In the secondary collectors market, cards are typically sold in one of three forms of packages: as individual cards, as packs of cards, and as boxes of packs of cards.

Individual cards are easy to value for sale based on scarcity and published evaluations. Packs of cards have certain valuation challenges because their contents are unknown. The buyer may open the pack, hoping to find some highly desired cards, or can keep the pack intact and hope of passing the unknown treasure to another collector for a greater price than what was paid. Boxes of packs are often sealed point of sale displays consisting of 24 or 36 packs of cards.

In the case of packs and boxes, it seems reasonable if a particular series of card packs typically sells for some amount that a box of 36 packs would sell for 36 times the amount of a single pack, plus some additional amount for the collectability of the unopened box itself. In practice though, as the price of a pack increases, an entire box may be priced out of the reach of most collectors. An owner of a box or boxes of cards can then either wait for a collector who can afford an entire box or open the boxes and sell the individual packs to collectors at near the price of an entire box.

There are several types of cases suitable or adaptable for the display and protection of individual cards and for packs (e.g., 10286714, 8376133, and 2007/0113451). Many cases known in the art that are used for packs themselves have a featureless internal space just large enough to contain the pack.

Although adequate at first blush, such cases do nothing to prevent the sealed flaps of the pack from becoming smashed or even split open by pressing against the walls of the case.

Another use of card pack cases is to ensure no one has replaced the contents. A common scam employed by unscrupulous sellers is to buy a pack of cards in a case on the secondary market, carefully remove the pack from the case, open the pack, replace any valuable cards with common cards from the same series, reseal the pack, and replace it in the case. A more secure case is designed so it can only be opened in one way so that placing a tamper-evident sticker on the opening of a case can help establish chain of custody and reduce the possibility of fraud.

SUMMARY OF THE INVENTION

Both of these needs are addressed by the subject matter of this application. The disclosed card pack case comprises features to support a pack of cards by the sealed flaps without allowing the ends of the flaps to touch the inside surface of the case. Further, the case is designed so that a tamper-evident seal can cover the only opening so gaining access to an item within the case from another point of attack requires breaking the case.

The card pack support is obtained by positioning the flaps of a pack between two pairs of rails. Each pair of rails is separated by a gap when the case is closed. When the encased pack is upright for display, the pack is too wide to slip through said gap and the distance between the end of the flap is sufficient to prevent the end of the flap from contacting the inside surface of the case.

The tamper-resistance of the case is obtained by designing the case so that one piece of the case fits within the other piece when closed, preventing a seam from being opened other than the one operable seam which can be made tamper-evident with a suitable sticker.

DETAILED DESCRIPTION

Figure 1:
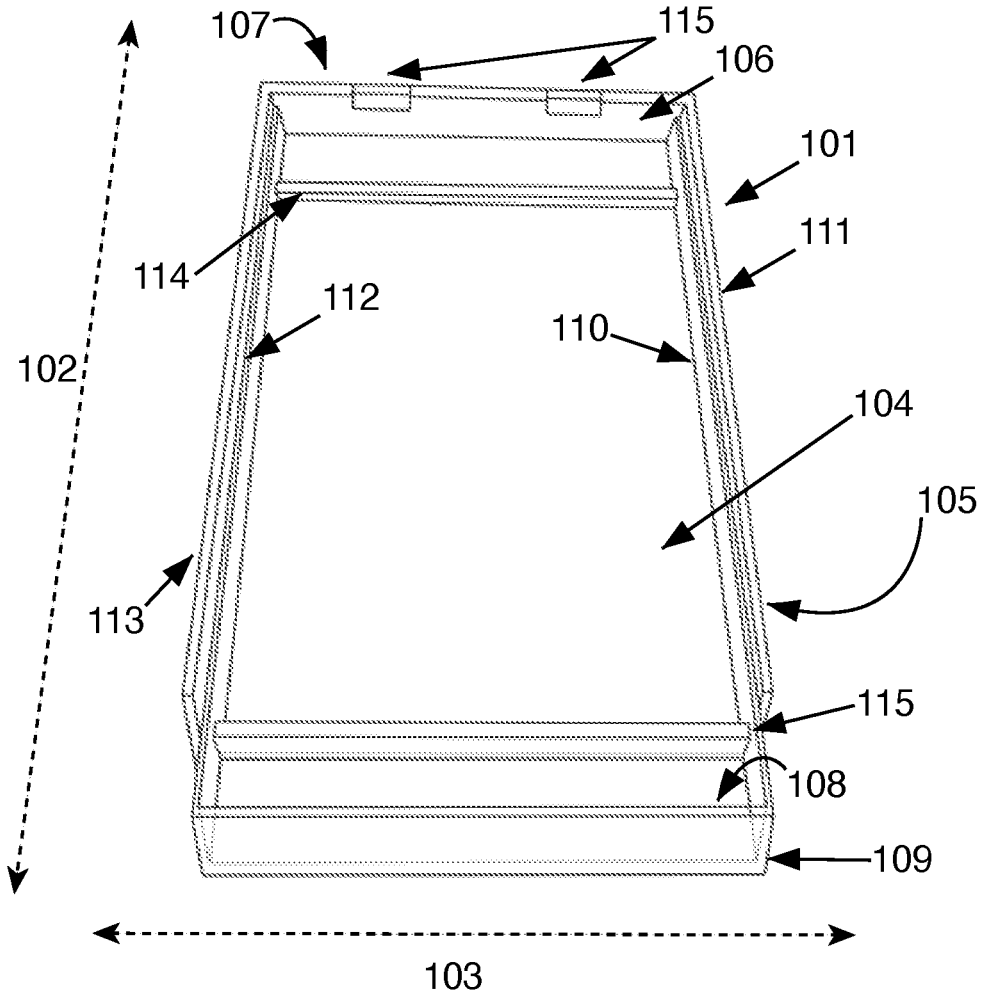
FIG. 1 is an illustration of the first piece of the collectible card pack case.
Figure 2:
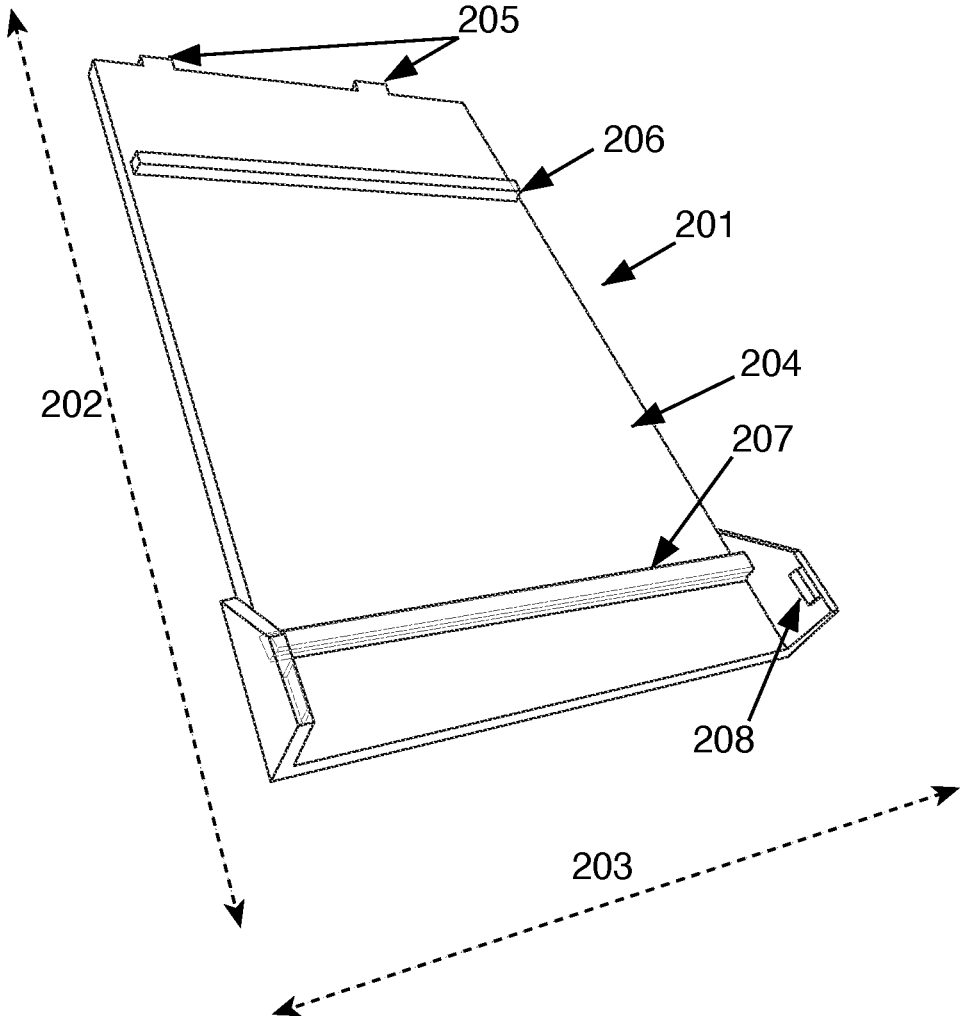
FIG. 2 is an illustration of the second piece of the collectible case.
Figure 3:
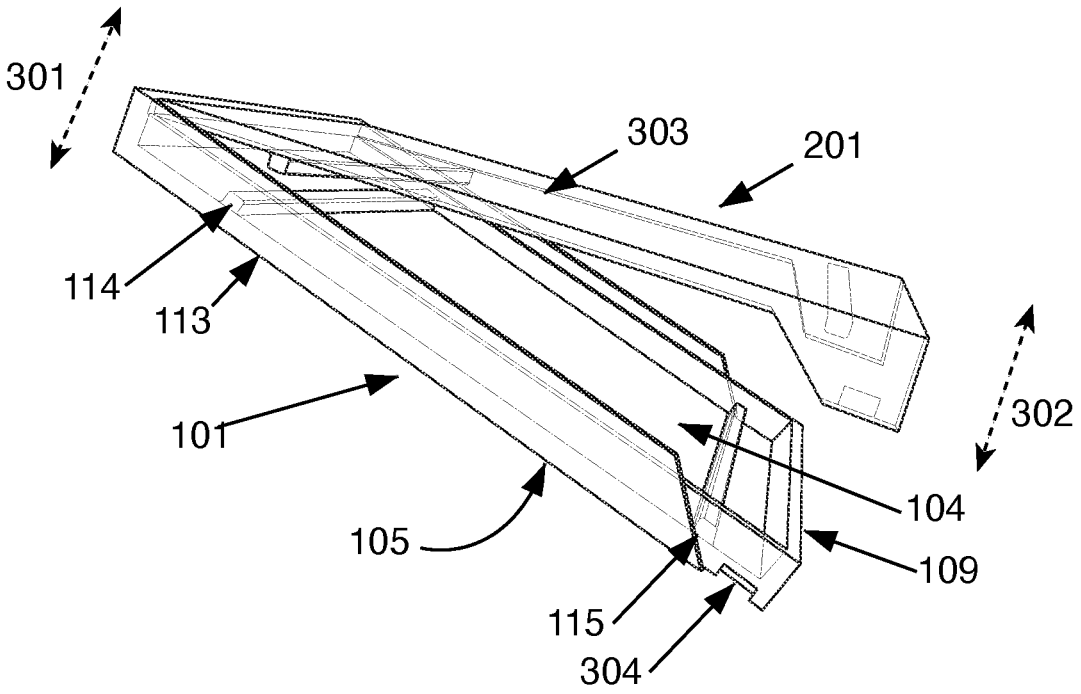
FIG. 3 is an illustration of the first and second pieces coming together.
Figure 4:
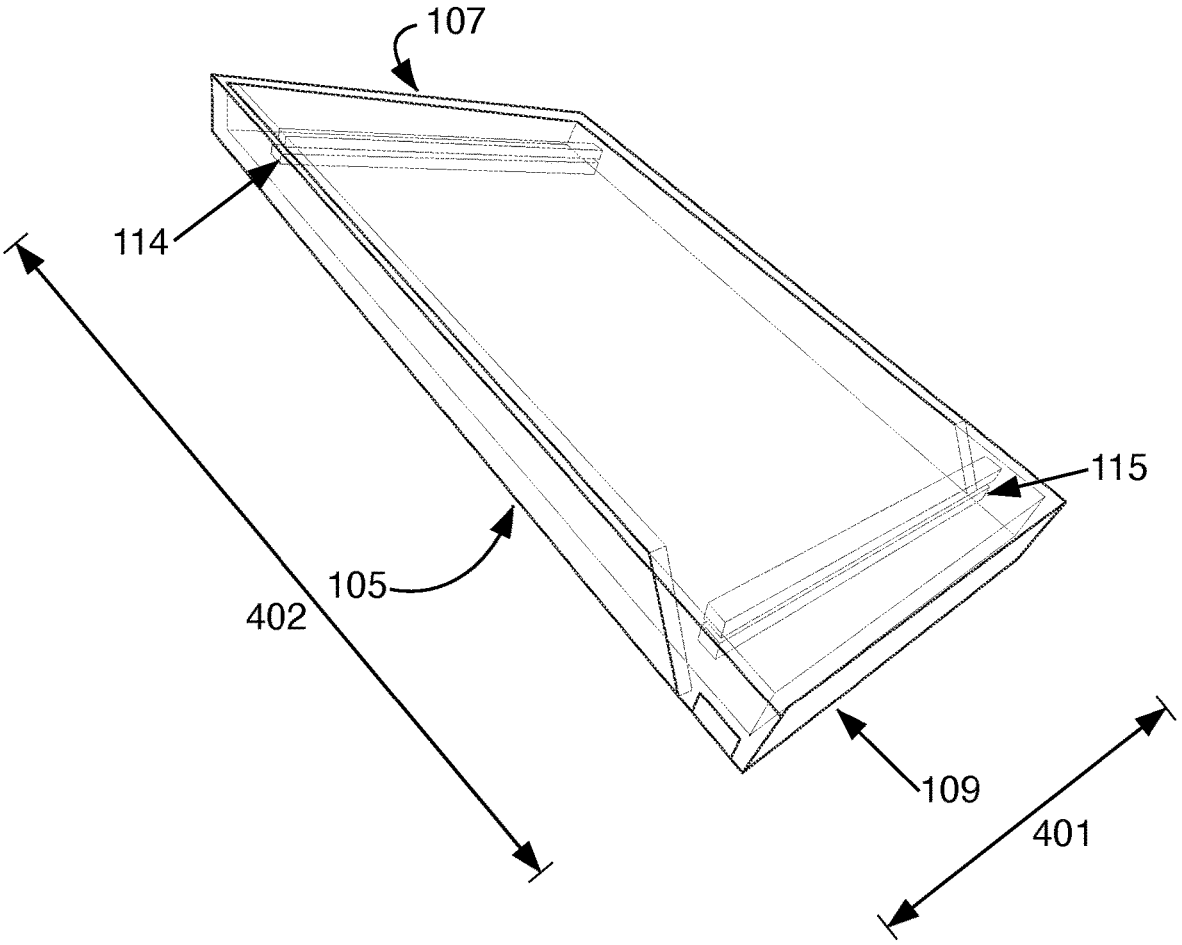
FIG. 4 is an illustration of the closed collectible case.
Figure 5:
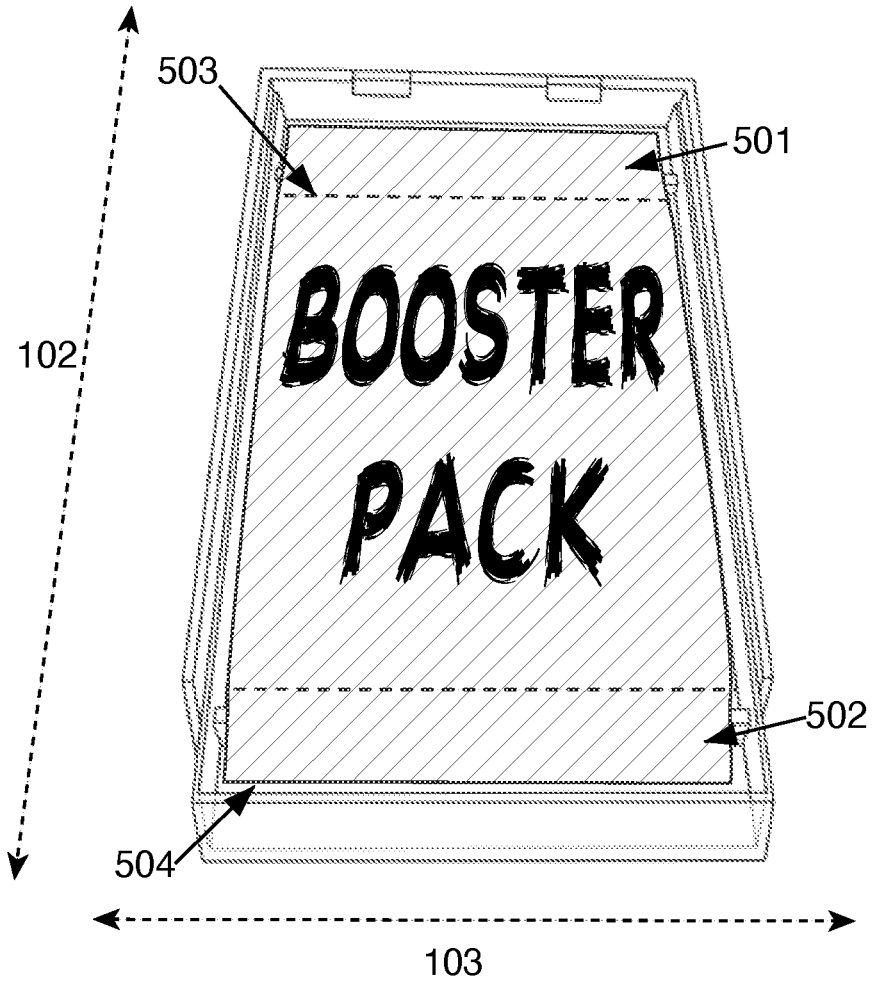
FIG. 5 is an illustration of the first piece of the collectible case with a card pack.
Figure 6:
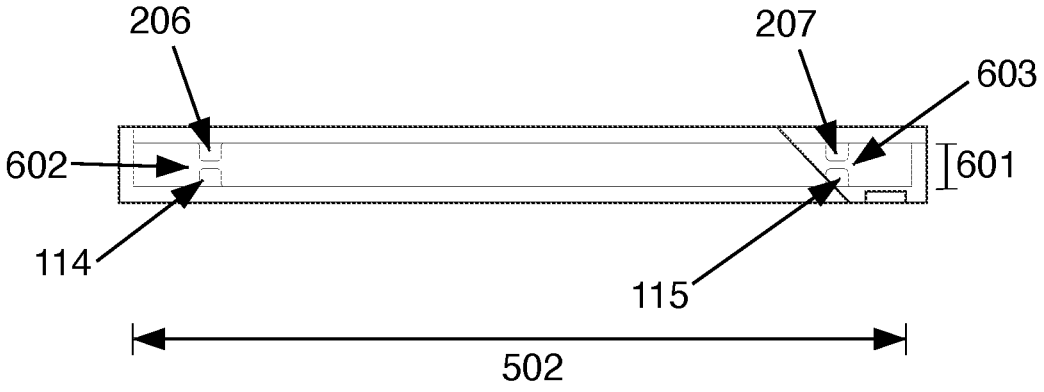
FIG. 6 is a side view of the closed collectible case.
Figure 7:
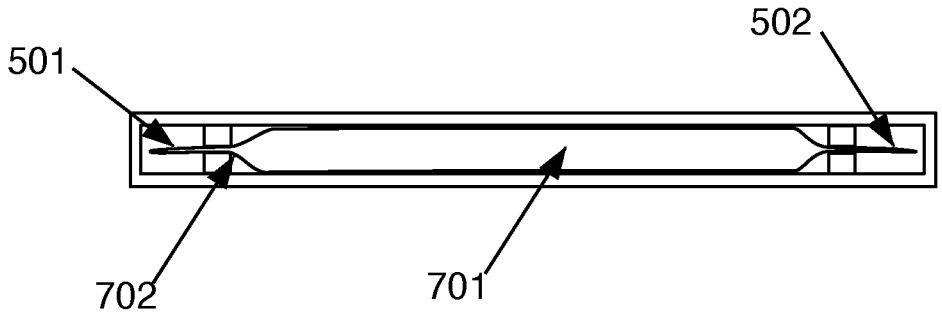
FIG. 7 is a view of a section of the case parallel to the height of the case showing a stored pack of cards.

The following description and drawings referenced illustrate embodiments of the subject matter of this application. They are not intended to limit the scope of any claim. Those familiar with the art will recognize that other embodiments of the disclosed subject matter are possible. All such alternative embodiments should be considered within the scope of the application's disclosure. For example, some specific dimensions are disclosed to describe a most highly preferred embodiment which may be more difficult to understand with less precise language. These exact dimensions, however, should not be read into the claims.

Each reference number consists of three digits. The first digit refers to the drawing in which the referenced aspect is first shown or in which the referenced feature is shown most clearly. Not every referenced feature is called out every time it is shown in a drawing.

As used, a "pack" or "pack of cards" or similar is understood to be a package containing some number of cards and a sealed top flap and a sealed bottom flap. Such packs are often called "booster" packs because they "boost" (augment) a starter pack. The body of the pack is the area between the flaps where the cards are contained. The terms "case," "case for a collectible," "case for a pack of cards," or similar are used interchangeably; descriptors such as "for a pack of cards" should be understood to offer context and not be used to narrow the claims.

In a preferred embodiment of the subject matter of this application, a case for a pack of cards ("case") comprises a first piece (101) and a second piece (201).

The first piece comprises a height measured along a Y axis (102), a width measured along an X axis (103), and a depth measured along a Z axis (301). The first piece further comprises an inner face (104) and an outer face (105), a top wall having an inner surface (106) and an outer surface (107), a bottom wall having an inner surface (108) and an outer surface (109), a first side wall having an inner surface (110) and an outer surface (111), and a second side wall having an inner surface (112) and an outer surface (113). Said inner face of the first piece comprises a first rail (114) and a second rail (115). The first rail and the second rail are parallel to each other and parallel to the X axis of the first piece. The first rail and the second rail each have a height parallel to the Z axis of the first piece.

The second piece comprises a height measured along a Y axis (202), a width measured along an X axis (203), and a depth measured along a Z axis (302). The second piece further comprises an inner face (204) and an outer face (303). Said inner face of the second piece comprises a first rail (206) and a second rail (207). The first rail and the second rail are parallel to each other and parallel to the X axis of the second piece. The first rail and the second rail each have a height parallel to the Z axis of the second piece.

In a highly preferred embodiment, the second piece further comprises at least one tab (205) and the top wall of the first piece further comprises at least one slot (115). The bottom wall of the first piece also comprises a first member of a two-member attachment system; and the second piece comprises a second member of a two-member attachment system. In a most highly preferred embodiment, said two-member attachment system is a tab and slot system in which pressing the first piece and the second piece together causes a tab (208) or tabs on one piece to engage with corresponding slots (304) on the other piece. To close the case the tabs of the second piece are inserted into the slots of the top wall of the first piece, thereby forming a hinge. Each member of the two-member attachment system are then pressed together causing one or more members to deflect until the paired bottom tabs and slots align and engage.

In a preferred embodiment, the depth of the second piece is nil or minimal as the second piece is a flat rectangle but for the said rails and any structure necessary to support said member of a two-member attachment system.

In certain embodiments, the second piece largely fits within the first piece when the two-member attachment system is engaged so that the outer face of the second piece is level with the first side wall and the second side wall of the first piece.

When the collectible card case is closed an internal space is formed having a width (401), a depth (601), and a height (402). The first rails of the first piece (114) and of the second piece (206) are aligned but separated by a gap (602). Similarly, the second rails of the first (115) and second (207) pieces are aligned and separated by a gap (603). The gap between the pairs of rails is large enough to allow the movement of the flaps of a pack of collectible cards within the gap, but not so large as to allow the body of the pack to slide between the rails.

In a most highly preferred embodiment, each of the rails has a height of less than one-half the depth of the internal space of the closed case.

In the most common and most highly preferred embodiment of the subject matter of this application, the collectible card case will accommodate a booster pack of cards. A common booster pack comprises a body (701), a top flap (501), and a bottom flap (502). Such cards themselves are approximately 63×88 mm (2.5×3.5 inches). The thickness of a single card is commonly 35 points (1 point being 0.0254 mm), although they can be thicker or thinner. A stack of cards, usually between 5 and 15 cards depending on the game, are surrounded by a cellophane sleeve which adds a trivial amount to the width of the stack of cards. Therefore a typical stack of 10 cards would be just under 9 mm thick. The bottom and top of the cellophane sleeve may be glued or heat-sealed, forming the top (501) and bottom (502) flaps. Each flap has a beginning nearest the body of the pack (e.g. 503) and an ending furthest from the body of the pack (e.g. 504). Each flap is commonly about 10-20 mm long. The body of the pack (701) has a top and bottom and is slightly larger than the cards themselves to account for a slant (e.g., 702) formed by the sleeve extending from the top and bottom of the stack to the beginning of the sealed flap. A typical booster pack, therefore, is slightly greater than 64 mm wide, roughly 110-130 mm long, and between about 9 and 15 mm thick. To contain such a pack, the collectible card case has an internal space of slightly greater than the pack in all directions and the rails are positioned such that the beginnings of each flap is positioned within the gap between a pair of rails when a pack is placed in the case. In all preferred embodiments, the gap is less than the thickness of the body of the pack. In this most highly preferred embodiment, each gap is between approximately 0.5 and 3 mm. In this way, the gap between the rails supports the pack by the flaps without crimping or distorting the flaps and when the case is upright for display, the pack is prevented from sliding through the gap by the slant of the sleeve.

To use the disclosed collectible card case with a such a booster pack one would place the booster pack on the first piece of the card case, approximately centered between the first and second rails of the first piece such that each flap of the pack extends over a rail. Once in place, the second piece of the card case is attached to the first and the booster pack is held between the two pairs or rails within the internal space of the closed case. In a closely related manner of use, the booster pack is placed across the rails of the second piece of the case before the first piece of the case is attached.

The invention claimed is:

1. A case for a collectible comprising an internal space, a first inner face and a second inner face;

A. said internal space having a width, a height, and a depth;

B. said first inner face comprising a first rail and a second rail;

i. said first rail having a height of less than one half the depth of the internal space, said rail extending across the width of the internal space;

ii. said second rail having a height of less than one half the depth of the internal space, said rail extending across the width of the internal space;

C. said second inner face comprising a first rail and a second rail;

i. said first rail having a height of less than one half the depth of the internal space, said rail extending across the width of the internal space;

ii. said second rail having a height of less than one half the depth of the internal space, said rail extending across the width of the internal space;

D. said first rail of the first inner face being parallel to the first rail of the second inner face, and forming a first gap between the said rails;

E. said second rail of the first inner face being parallel to the second rail of the second inner face, and forming a second gap between the said rails.

2. The case for a collectible of claim 1 in which said collectible comprises a body, a first flap, and a second flap such that when the collectible is within said case, the first flap of the collectible is at least partially located within the first gap and the second flap of the collectible is at least partially located within the second gap.

3. The case for a collectible of claim 1 in which said case is comprised of a first portion and a second portion;

A. said first portion comprising said first inner face and a first member of a two-member fastening system; and B. said second portion comprising said second inner face and a second member of a two-member fastening system.

4. A method of securing a collectible within a case in which

A. said collectible includes a body, a first flap, and a second flap; and in which B. said case for a collectible includes an internal space, a first portion comprising a first member of a two-member fastening system and a first inner face, and a second portion comprising a second member of a two-member fastening system and a second inner face;

i. said internal space having a width, a height, and a depth;

ii. said first inner face comprising a first rail and a second rail;

a. said first rail having a height of less than one half the depth of the internal space, said rail extending across the width of the internal space;

b. said second rail having a height of less than one half the depth of the internal space, said rail extending across the width of the internal space;

iii. said second inner face comprising a first rail and a second rail;

a. said first rail having a height of less than one half the depth of the internal space, said rail extending across the width of the internal space;

b. said second rail having a height of less than one half the depth of the internal space, said rail extending across the width of the internal space;

iv. said first rail of the first inner face being parallel to the first rail of the second inner face, and forming a first gap between the said rails;

v. said second rail of the first inner face being parallel to the second rail of the second inner face, and forming a second gap between the said rails;

C. said method involving the steps of: placing the collectible on the first and the second rail of either the first or the second inner face such that the body of the collectible is approximately centered between the first rail and the second rail and the first flap of the collectible is on top of the first rail and the bottom flap of the collectible is on top of the second rail, engaging the paired members of the two-member fastening system to secure the first portion of the case to the second portion of the case.

* * * * *